United States Patent [19]

Mellinger et al.

[11] 3,978,960

[45] Sept. 7, 1976

[54] COIN AUTHENTICATING SLIDE MECHANISM

[75] Inventors: John C. Mellinger; William J. McNally, both of Newton, Iowa

[73] Assignee: The Maytag Company, Newton, Iowa

[22] Filed: Nov. 19, 1975

[21] Appl. No.: 633,447

[52] U.S. Cl. ..... 194/55; 194/102

[51] Int. Cl.[2] ..... G07F 3/02

[58] Field of Search ..... 194/55, 56, 57, 58, 194/59, 60, 101, 102, 1 G

[56] References Cited

UNITED STATES PATENTS

| | | | |
|---|---|---|---|
| 2,925,163 | 2/1960 | Parre et al. | 194/55 |
| 3,602,352 | 8/1971 | Robinson | 194/92 |
| 3,712,440 | 1/1973 | Greenwald | 194/55 |
| 3,732,962 | 5/1973 | Hall | 194/92 |

*Primary Examiner*—Allen N. Knowles
*Attorney, Agent, or Firm*—Richard L. Ward

[57] ABSTRACT

A coin slide apparatus which includes a housing for mounting the apparatus to a machine, a coin slide assembly, and a guideway in the housing for the coin slide assembly to operate within. The coin slide assembly is reciprocally operable in the guideway from an extended coin receiving position through coin authenticating and coin ejection positions to a position for operation of the machine. The coin side assembly provides a first coin authenticating means through the size and shape of the coin slots. Further authentication or measuring means are provided through provisions for washer or magnetic coin rejection means. The coins are secondarily measured for proper diameter within the apparatus by a cam and abutment arrangement which cooperates with a plurality of latch arms to prevent full insertion of the slide assembly if a coin is not of proper diameter. Also, a change in coin elevation from a first higher elevation to a second lower elevation is provided to prevent improper actuation by wedging an object in a slot or slots. Coin ejection means is provided after authentication to insure that coins are deposited in the coin receptacle.

23 Claims, 24 Drawing Figures

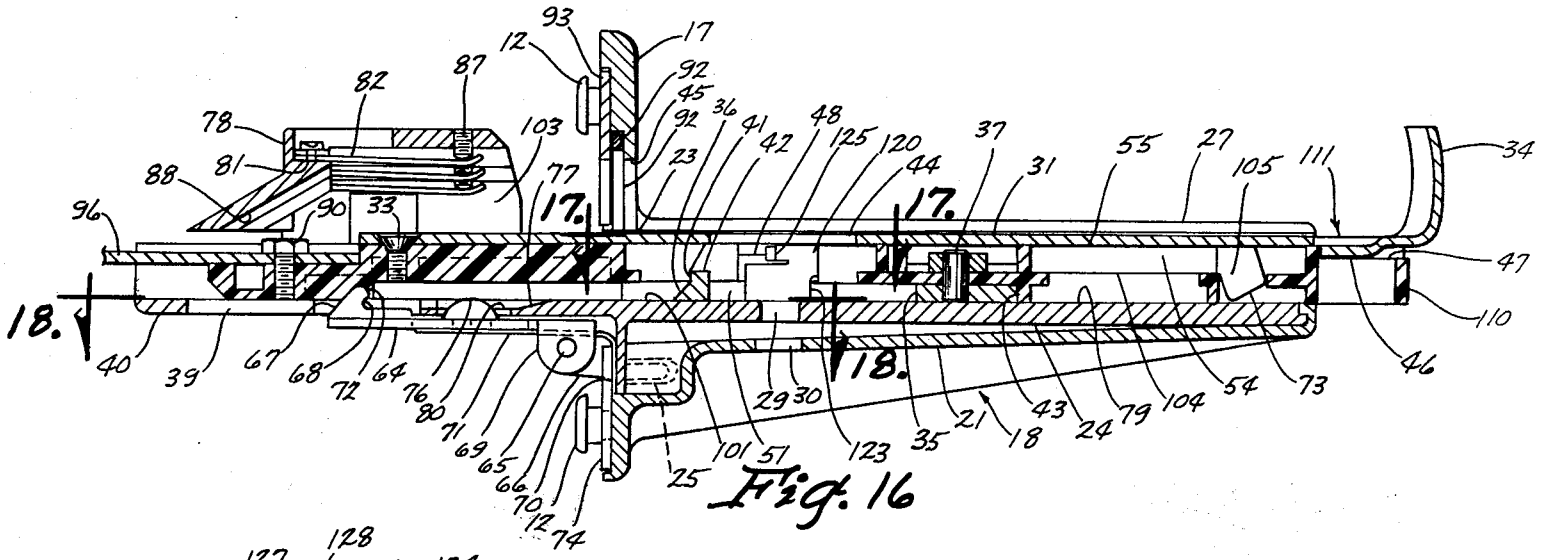
Fig. 16
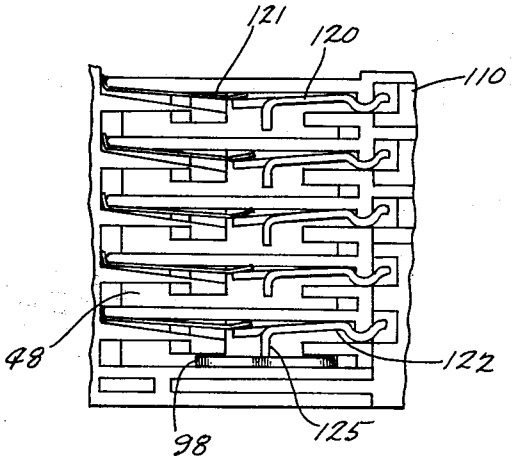
Fig. 17
Fig. 18
Fig. 19
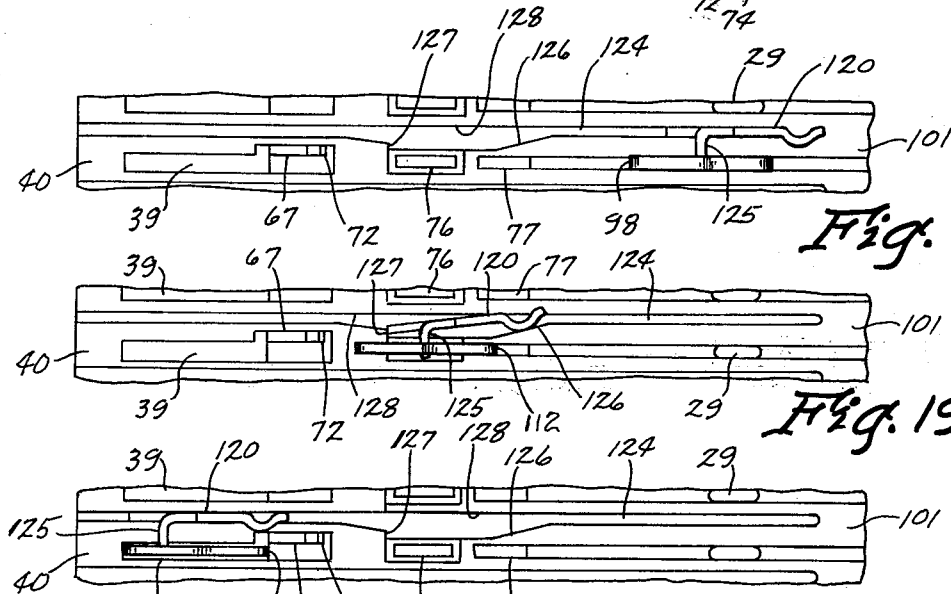
Fig. 20

COIN AUTHENTICATING SLIDE MECHANISM

BACKGROUND OF THE INVENTION

1. Field of the Invention

This invention relates to the field of coin actuated machines and more particularly to coin measuring and authenticating apparatus therefor.

2. Description of the Prior Art

Prior coin slide art shows a continuing search for methods of coin measuring and authentication. U.S. Pat. No. 3,602,352, for example, discloses a system that checks the coin thickness and diameter at the coin slide and further checks the thickness and diameter as the coin moves into the apparatus. This patent also suggests alternate checks for ferrous coins and for washers with all checks made at one coin elevation. U.S. Pat. No. 3,712,440 also checks all coins for thickness and diameter at one elevation and does not provide for rejecting a magnetic slug or a washer. Further, in U.S. Pat. No. 3,372,962 the coins are moved from a lower level to a higher level where the top edges of all coins are in the same plane during measuring for thickness and diameter. Magnets are mounted in the stationary portion of the housing for moving toward a ferrous coin and consequent jamming of the slide mechanism. Washers are stopped by two parallel fingers in the coin path which engage the hole in the washer and prevent the slide from advancing. There remains, however, a need for a coin slide apparatus operable for detecting and rejecting spurious coins or the like as well as detecting and rejecting spurious operating techniques.

SUMMARY OF THE INVENTION

It is an object of the instant invention to provide an improved coin slide apparatus.

It is a further object of the instant invention to provide an improved coin authentication apparatus.

It is a further object of the instant invention to provide a unique magnetic or a washer reject means.

It is a further object of the instant invention to provide a means for preventing actuation of the machine with coins of improper diameter.

It is a still further object of the instant invention to prevent actuation by wedging objects in the coin slots.

Briefly, the instant invention achieves these objects in a coin slide apparatus that includes a housing and associated mounting means; a coin slide assembly including coin slots for receiving and supporting coins, latch arms pivotally mounted to the slide housing to prevent full movement of the slide assembly if improper coins are inserted, and a coin measuring means including a cam portion of the latch arms and abutments above the cams.

Operation of the apparatus and further objects and advantages thereof will become evident as the description proceeds and from an examination of the accompanying nine pages of drawings.

BRIEF DESCRIPTION OF THE DRAWINGS

The drawings illustrate a preferred embodiment of the invention with similar numerals referring to similar parts throughout the several views, wherein:

FIG. 16 is a view similar to FIG. 2 showing a part of the washer reject means in relation to the coin slide and slide housing;

FIG. 17 is a fragmentary view taken along lines 17—17 in FIG. 16;

FIG. 18 is a fragmentary view taken generally along lines 18—18 of FIG. 16 with the slide assembly in the coin receiving position and carrying either a coin or a washer;

FIG. 19 is a view similar to FIG. 18 with the slide assembly partially advanced and carrying a washer;

FIG. 20 is a view similar to FIG. 18 with the slide assembly advanced and carrying a proper coin;

DESCRIPTION OF A PREFERRED EMBODIMENT

Figure 1:
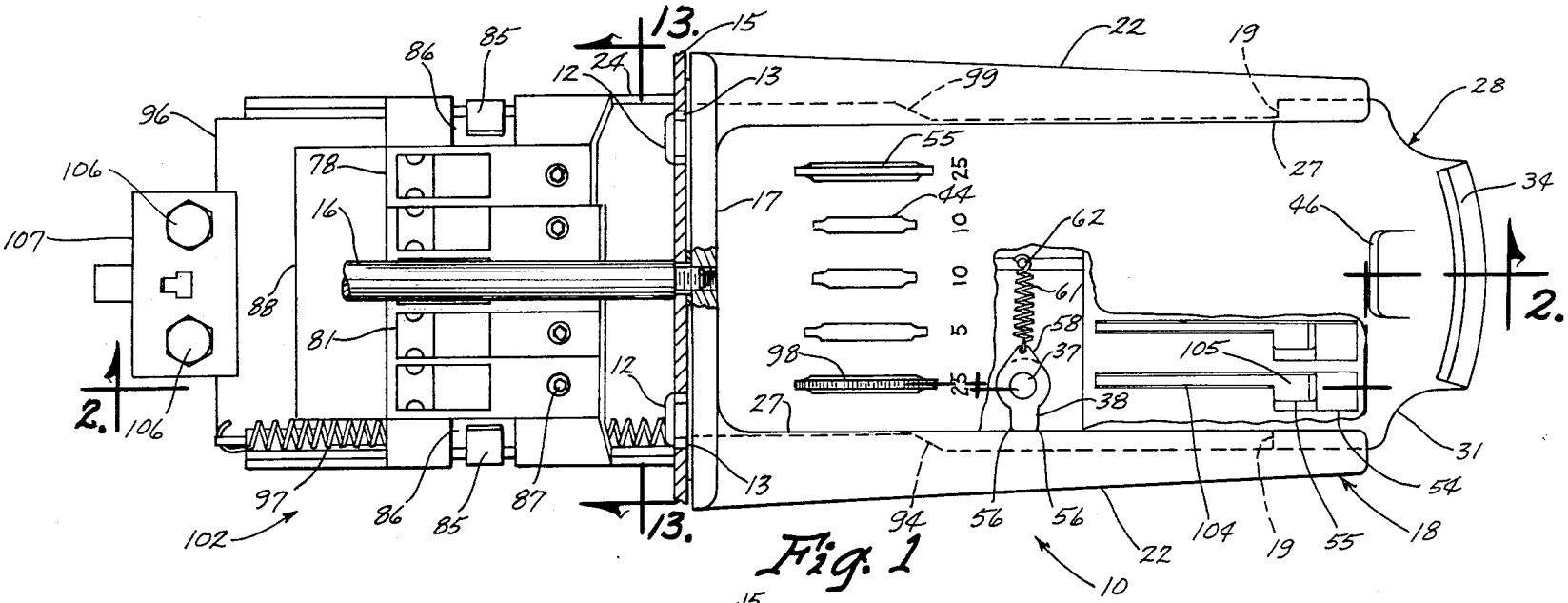
FIG. 1 is a plan view of the coin slide apparatus with a portion broken away to show the ratchet pawl and the blanking members in storage.
Figure 2:
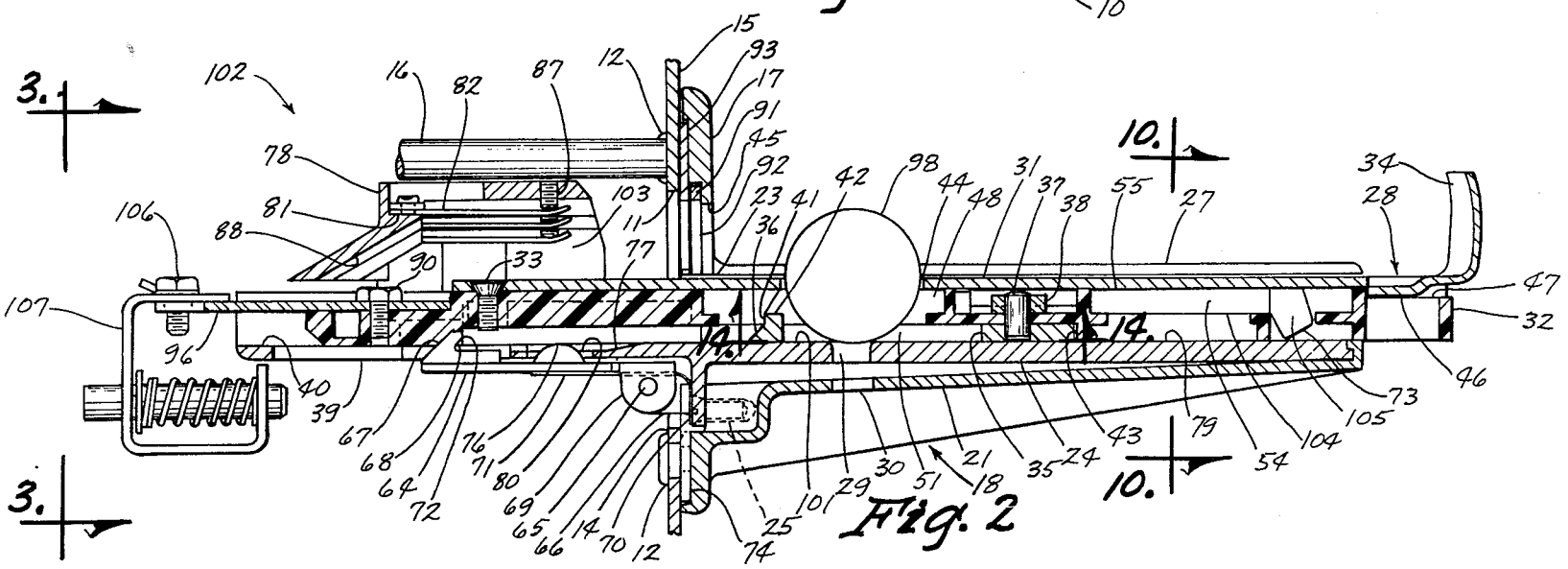
FIG. 2 is a sectional view taken along section lines 2—2 of FIG. 1, showing interior construction detail along a coin slot.

Referring to the drawings there is shown generally in FIG. 1 and further in the additional drawings a coin slide apparatus 10 so constructed as to be mounted in a standard coin slide vault panel opening 11, as shown in FIGS. 1 and 2, and thereby supported on a machine which is to be actuated by such a coin slide apparatus 10.

Referring to FIGS. 1 and 2, the coin slide apparatus 10 is mounted in a standard opening 11 cut into the front panel of the coin slide vault. This mounting is accomplished by sliding the apparatus 10 into the opening 11 and allowing the shouldered screws 12 to pass through clearance holes 13 at the top and clearance slots 14 at the bottom of the opening. The shoulder of the screws 12 allows the apparatus 10 to grip the vault wall 15 and final securing of the apparatus 10 is accomplished from within the vault by tightening a threaded rod 16 into faceplate 17 which draws the apparatus 10 snugly against the vault wall 15.

Figure 10:
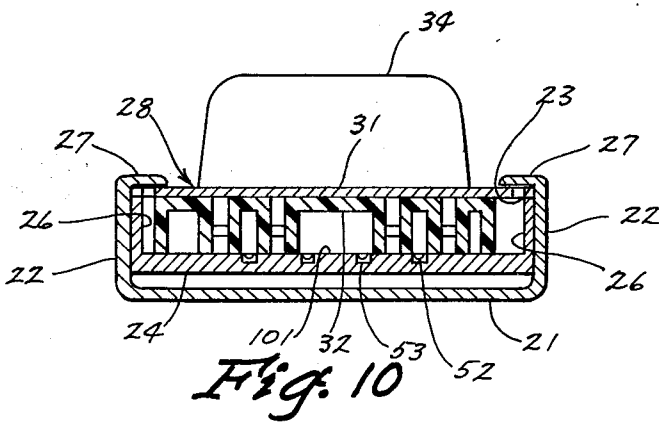
FIG. 10 is a section taken along lines 10—10 of FIG. 2.

Referring again to FIGS. 1, 2 and 3 the coin slide apparatus 10 includes a faceplate 17 and a forwardly extending housing support 18 which are cast as a unitary member. The forwardly extending housing support 18 includes a base 21 and a pair of opposed side walls 22 having inwardly extending flanges 27, as shown in FIG. 10, to define a rearwardly extending longitudinal channel 23 through the faceplate 17.

Figure 3:
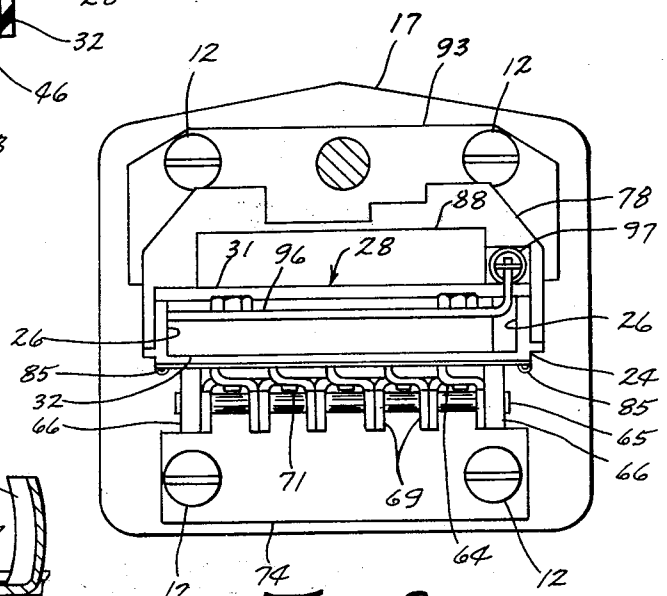
FIG. 3 is an end view taken along lines 3—3 of FIG. 2.

Assembled into the longitudinal opening 23 from the rear of the faceplate 17 is a slide housing 24, as shown in FIG. 2. The slide housing 24 is connected to the combination faceplate housing support by a pair of threaded fasteners 25. The slide housing 24 includes a short upwardly extending wall 26 at each side, as best shown in FIGS. 3 and 10, which cooperates with the flange 27 on the channels 22 of the housing support 18 to provide a guideway for a horizontally reciprocal slide assembly 28.

The slide housing 24 further includes an array of holes 29 in the guideway surface 101 and generally in line with a slotted opening 30 in the base 21 of the housing support 18. These holes 29 in combination with the slotted opening 30, provide limited access to the coins 98 from below and provide an outlet for dirt or soap granules.

Figure 14:
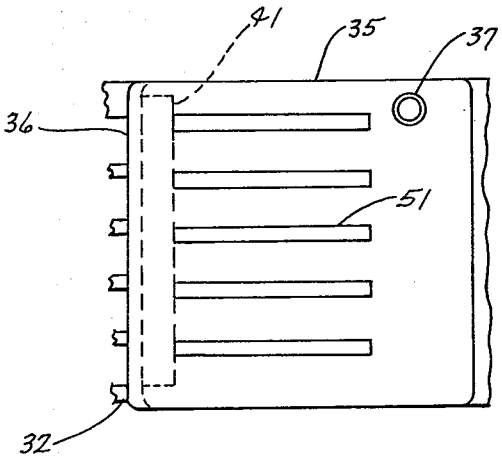
FIG. 14 is a view along lines 14—14 of FIG. 2 showing the bottom of the latch plate.

The reciprocally movable slide assembly 28 includes an upper slide plate 31 which is fixed to a center plate or center body portion 32 by a pair of screws 33. The upper slide plate 31 also includes an upturned handle 34, at the end opposite the screws 33, for operation of the slide assembly 28 within the guideway defined by the inwardly extending flanges 27 and upwardly extending walls 26 as shown in FIG. 10. The center body 32 is formed to receive a latch plate 35 as shown in FIGS. 2 and 14. The latch plate 35 is hardened and has a beveled leading edge 36 and a studlike projection 37 which extends through the center body 32 to provide a pivot support for a ratchet pawl 38 which will be further defined. Immediately adjacent the beveled leading edge 36 of the latch plate 35 is a rib section 41 that extends transversely across the latch plate 35 as in FIGS. 2 and 14. This rib section 41 mates with a transverse groove 42 in the body portion 32 of the slide assembly 28 to locate the forward edge of the latch plate 35. The rear of the latch plate 35 is maintained in position by a downwardly extending wall 43 in the body portion 32. These features cooperating with the guideway serve to retain the latch plate 35 as part of the slide assembly 28.

The upper slide plate 31 includes coin slots 44 which are sized to receive coins 98 having particular denominations including two slots for quarters, two slots for dimes, and one slot for a nickel. The slots 44 in the upper slide plate 31 are aligned with vertical passageways 45, see FIGS. 2, 11 and 12, in the faceplate 17 which permit the passage of coins 98 that are positioned in the slide slots 44 and which partially extend above the surface of the upper slide plate 31. Though five slots 44 are shown in the upper slide plate 31, means are provided for blanking off up to four slots 44 as will be shown and discussed hereinbelow.

The coin slots 44 are shaped, as shown in FIG. 1, to approximate a particular coin's maximum permissible thickness and diameter at each end but are substantially wider at the center to accommodate a coin 98 which may be of the proper denomination but slightly deformed in the center. These slots 44 perform a preliminary measuring of a coin's width and thickness. The upper slide plate 31 also includes a rectangular detent 46 as shown in FIGS. 1 and 2. This detent rests in a notch 47 at the front of the center body 32 with the deepest portion of the detent 46 contacting the wall of notch 47. When the slide assembly 28 is operated, the detent 46 and notch 47 combination serves to transmit the operational impact force from the handle 34 and upper slide plate 31 to the center body 32 which prevents the application of undue force on the screws 33 that connect the upper plate 31 and center body 32.

As shown in FIG. 2, the center body 32 provides substantial thickness to the slide assembly 28 as compared to the thickness of the upper slide plate 31, and thus a significant portion of the coin 98 diameter is below the surface of the upper slide plate 31 when the coin 98 is of proper diameter. The center body portion 32 is molded from a thermoplastic material and includes a first transverse row of coin receiving pockets 48 below and substantially aligned with the slots 44 in the upper plate 31 but these coin receiving pockets 48 are of uniform size rather than of a size that corresponds to the size of the juxtaposed slot 44 in the upper slide plate 31. The latch plate 35 includes elongated openings 51 aligned with the slots 44 in the upper plate 31 and the first pockets 48 in the center body portion 32, as shown in FIGS. 2 and 14, to allow the lower edge of inserted coins to rest on the edges of the hole 29 on the surface of the guideway 101 of the slide housing 24.

As shown in FIG. 10, the center body portion 32 also includes a plurality of relatively small depending ribs 52 which mate with a plurality of shallow grooves 53 cast into the surface of the guideway 101 of the slide housing 24. These mating ribs 52 and grooves 53 cooperate to prevent the insertion of a thin flat sheet of rigid material between the slide assembly 28 and the slide housing 24 that is intended to effect improper actuation of the coin slide apparatus 10. The center body 32 further includes a second row of pockets or recesses 54, as shown in FIGS. 1 and 2, to receive in storage a plurality of blanking members 55.

Figure 9:
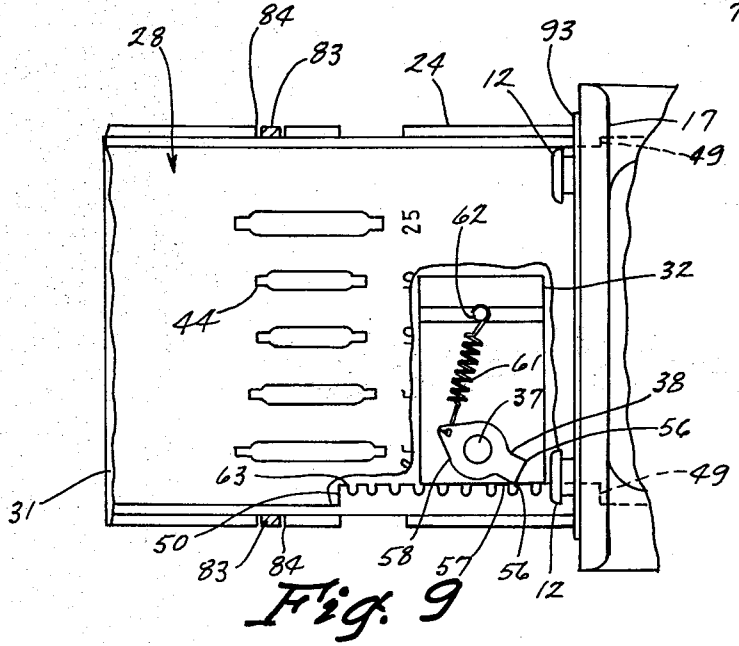
FIG. 9 is a fragmentary section showing the slide partially advanced.

The center body 32 supports a ratchet mechanism, as shown in FIGS. 1 and 9, where the pawl 38 is pivotally mounted on the projecting stud 37 of the latch plate 35. The rachet pawl 38 is a hardened metal part having a center pivot with a generally rectangular shape at one end defining two sharp edges 56 for engagement with ratchet teeth 57 on either the forward or return stroke of the slide assembly 28 and a tapered opposite end 58 for attaching a pawl biasing member 61. The pawl biasing member 61 is connected between a molded peg 62 on the center body 32 and the trailing tapered portion 58 of the ratchet pawl 38. The toothed portion 57 of the ratchet mechanism is cast into a sidewall 63 of the slide housing 24 as shown in FIG. 9 and is operable for engagement with the ratchet pawl 38. Once the coin 98 passes through the coin measuring area 103, the ratchet pawl 38 engages with a ratchet tooth 57 as shown in FIG. 9 thus requiring the slide assembly 28 to be advanced past the remaining ratchet teeth 57. Once the slide assembly 28 and ratchet pawl 38 have been advanced past the ratchet teeth 57 to the operative position, as shown in dashed lines in FIG. 15, the ratchet pawl 38 will reverse and the ratchet teeth 57 will engage in a reverse direction during withdrawal of the slide assembly 28 so that the slide assembly 28 cannot be returned to the operative position before returning to the coin receiving position. The ratchet mechanism thus functions to require a complete slide assembly 28 reciprocation once an actuation has been effected so that coins cannot be returned rather than being ejected into a coin receptacle within the vault 102.

Pivotally mounted to the assembly of the housing support 18 and slide housing 24 are a plurality of latch arms 64, with one generally aligned with each of the slots 44 in the slide housing 24, as shown in FIGS. 2 and 3. These latch arms 64 are individually pivoted by a pair of downwardly turned ears 69 on a pin 65 which is in turn supported by two depending tabs 66 on the slide housing 24, FIG. 3. Each latch arm 64 includes at its free end a pawl 67 offset from the coin cam 76 center line and having a reverse inclined face 68 engageable with the hardened leading edge 36 of the latch plate 35 when the pawl 67 is in a first posture as shown in FIGS. 2 and 3 under the biasing of a leaf spring 71. Forwardly adjacent the inclined face 68, the edge 72 of the pawl 67 is beveled for engaging with the ramp portion 73 of a blanking member 55 to be described hereinbelow. A one-piece spring assembly 70 having a plurality of leaf springs 71 is formed from a flat sheet of spring stock. The individual leaf springs 71 are bent at right angles to the remaining rectangular sheet so that they extend rearwardly under each latch arm 64 to upwardly bias each arm 64. The remaining rectangular base portion of the spring assembly 70 is retained by the slide housing 24 through a flat rectangular plate 74 and a pair of shouldered mounting screws 12, as shown in FIGS. 2 and 3. Each latch arm 64 also includes, at a position intermediate the pivot end and the free end, an upwardly extending, semicircular, cam surface 76 engageable with an inserted coin 98.

Also included in the surface of the guideway 101 of the slide housing 24 is a downward sloping ramp 77 which causes the coin or coins to drop by gravity from a first higher elevation 79 to a second lower elevation 80 prior to measuring. This change in elevation from higher to lower is necessary so that if an object other than a coin 98 is wedged into the coin slot 44 the object will not cam the latch arm 64 down since the object will be wedged at the higher elevation and will therefore be too high to engage the cam 76. The requirement that the coin 98 drop by gravity from a higher to a lower elevation requires that the coin 98 be free, whereas, if the coin 98 were being elevated from a lower level to a higher level a spurious coin could be wedged into the slot and be forced into the coin measuring area 103.

The most significant coin measuring is effected by a measuring system including the cam surface 76 of the latch arm 64. Behind the faceplate 17 is a bridge 78, as shown in FIGS. 1, 2, 3, and 13, having at irregular heights, supports 81 for flat finger-like abutments 82 which are engageable with a coin diameter. The bridge 78 is located on the slide housing 24 as in FIG. 1 by means of tabs 83 on the lower edges of the bridge 78 and mating slots 84 on the edge of the slide housing 24 as best shown in FIG. 9. The bridge 78 is secured to the slide housing 24 with two snap flat springs 85, as in FIG. 1, which hook under the slide housing 24, as in FIG. 3, and snap into a recess 86 on each side of the bridge 78. The bridge 78 is thus restrained from movement and disassembly is simple.

Each abutment 82 is disposed above the coin cam 76 of a latch arm 64 with one end secured to the bridge 78 by staking and the opposite end positioned by a setscrew 87. The position of one end of the abutment 82 is adjustable with the setscrew 87, as in FIG. 2, so that the predetermined spacing between the abutment 82 and the coin cam 76 is such as to pivot the latch pawl 67 downward into a second posture for nonengagement with the latch plate 35 in the presence of a proper coin diameter. That ramp portion 88 of the bridge 78 immediately rearward of the coin measuring area 103 is sloped downward and rearward, as shown in FIG. 2, to impart a downward and rearward thrust to the coin 98 as it is ejected from the coin slide 28 through a port 39 in the slide housng 24. The combination of the ramp 88 and a bar 40 at the end of the port 39 in the slide housing 24 serves to strip any coin 98 from the slide assembly 28 which may have been taped or otherwise held to the slide in an attempt to retrieve the coin 98 after actuation.

As previously indicated, up to four of the five coin lots 44 may be blocked off so that the indicated coin 98 is not required and in fact cannot be inserted into the coin slot 44 of the upper slide plate 31. Stored within the second center body recesses 54, as shown in FIGS. 1 and 2, are coin-blanking members 55 which are fabricated from a nonmagnetic material and include an elongated body portion 104 and a head portion 105 having a ramp 73 on the underside for engaging with the beveled edge 72 of the latch arm pawl 67 and camming the arm 64 downward into the previously mentioned second posture for nonengagement with the latch plate.

Figure 4:
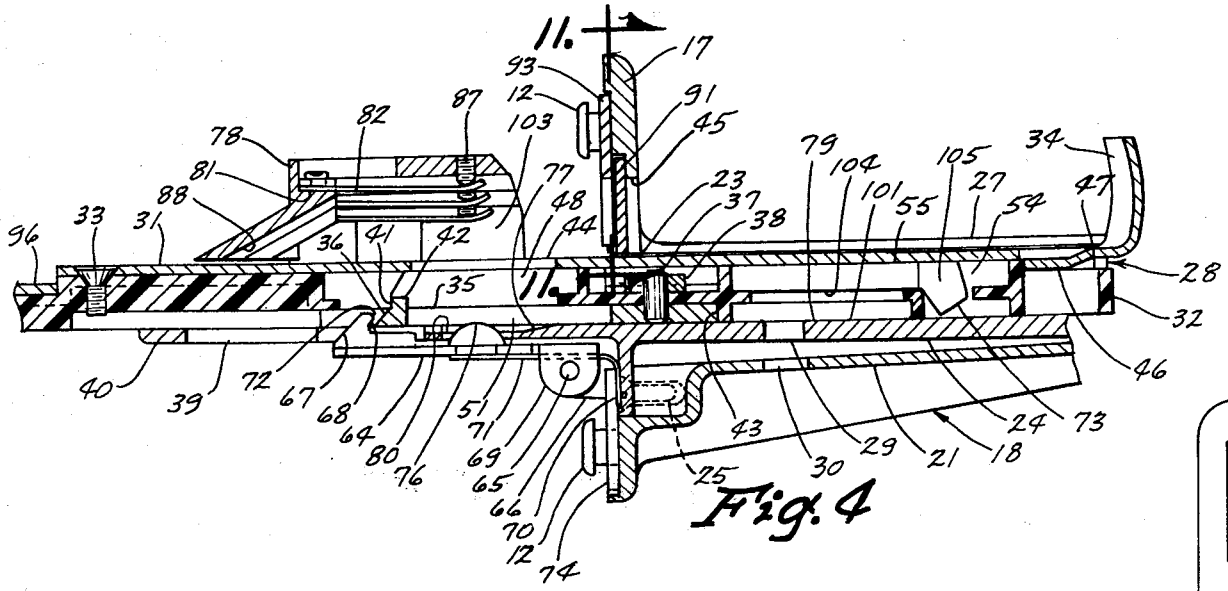
FIG. 4 is a view similar to FIG. 2 but showing the slide assembly advanced to an intermediate position without any coins.
Figure 7:
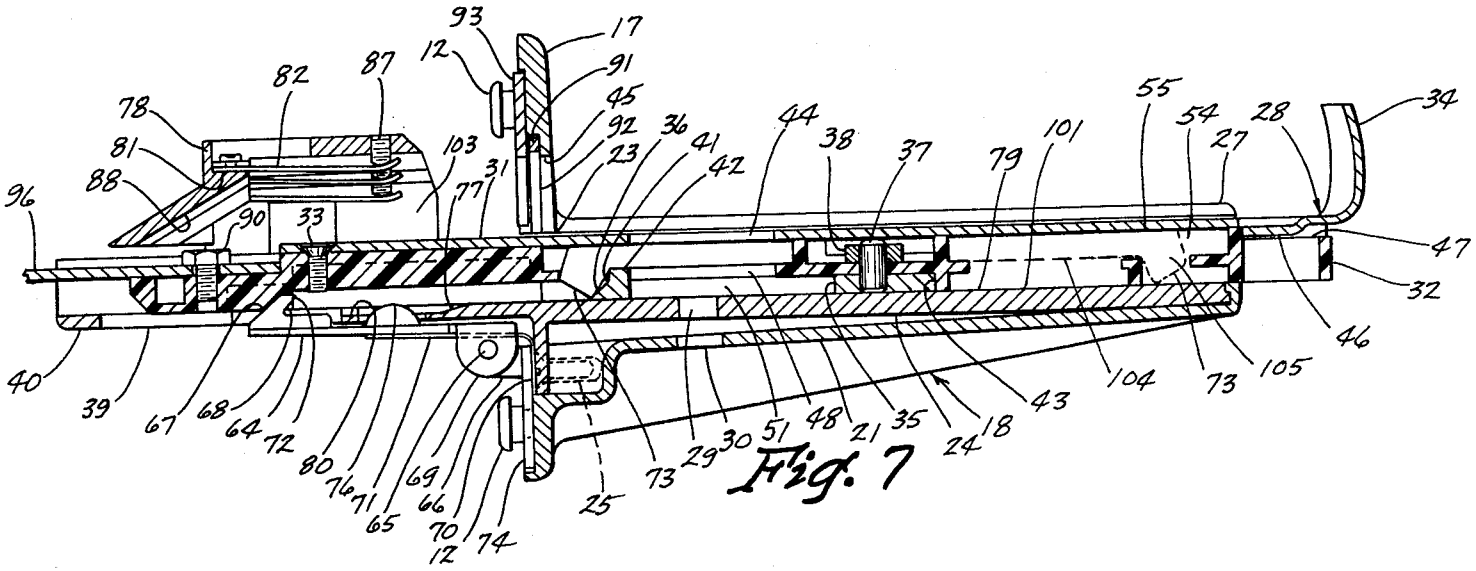
FIG. 7 is a view similar to FIG. 2 showing a blanking member in operative position.

To remove the upper slide plate 31 for conversion of the coin slide apparatus 10 from one combination of coins 98 to another, the slide assembly 28 is moved partially inward to expose the two mounting screws 33 as in FIG. 4. By removing these two screws 33 the upper slide plate 31 may be removed by sliding it forward through the faceplate 17 and away from the center plate 32 of the slide assembly 28 to expose the blanking members 55 disposed in the second row of pockets 54, as shown by broken line in FIG. 7, without disassembly of other parts. The blanking members 55 may then be removed from the second row of storage pockets or recesses 54 and placed in the first coin pockets 48 so that the elongated body portion 104 will underlie the coin slot 44 in the upper slide plate 31 and the head portion 105 will extend downwardly to a position juxtaposed and to the left of the leading edge 36 of the latch plate 35 as in FIG. 7. The coin receiving slots 44 may be selectively blocked off so that the slide 28 may be adapted to receive and actuate at any five cent increment between a coin value of 5 cents to 75 cents. When the blanking members 55 are in a slot blanking position as shown by the unbroken line in FIG. 7, a coin 98 cannot be inserted into the coin slot 44 of the upper slide plate 31, and as the slide assembly 28 is advanced to the coin measuring area 103, the ramp 73 on the underside of the head 105 operates to engage the latch pawl 67 and to depress it to a position below the lower surface of the latch plate 35 to thus obviate the need for a coin 98 in the particular slot.

Figure 8:
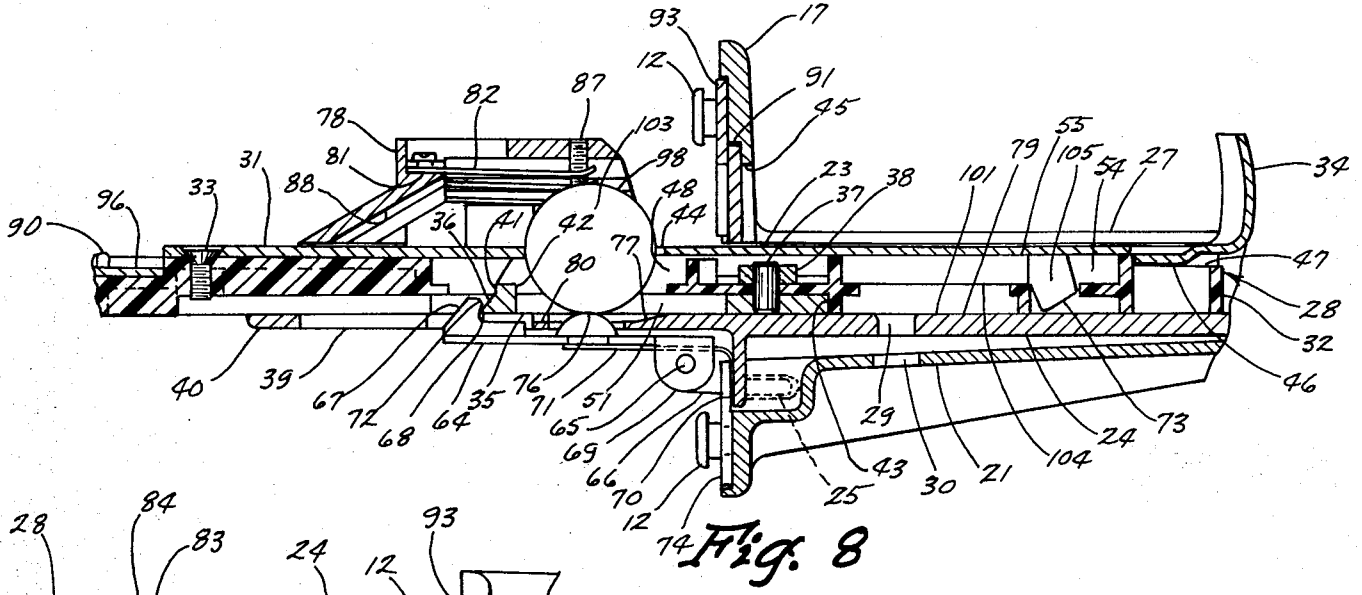
FIG. 8 is a view similar to FIG. 2 showing that a too small coin will not pass through the coin measuring area.
Figure 12:
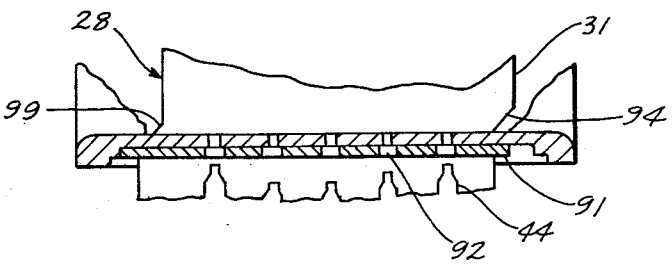
FIG. 12 is a section taken along lines 12—12 of FIG. 11 showing the action of the door as the slide is advanced or retracted.
Figure 11:
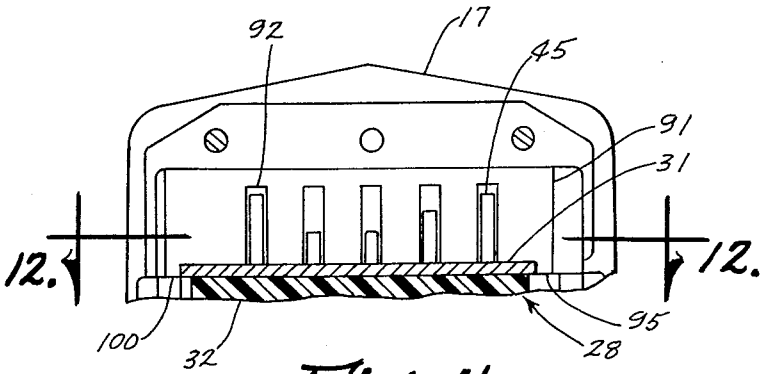
FIG. 11 is a section taken along lines 11—11 of FIG. 4 showing the slide actuated door in the housing support.
Figure 13:
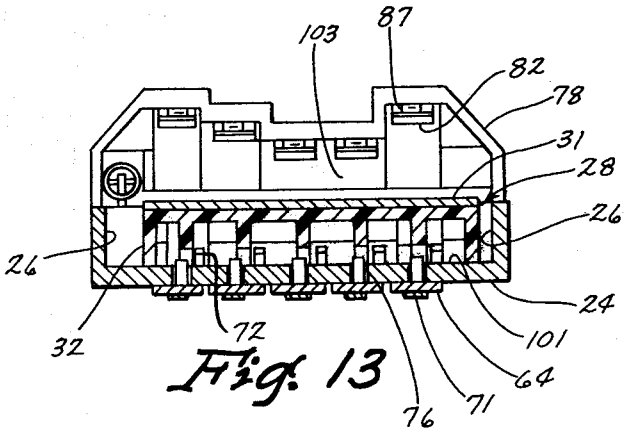
FIG. 13 is a section taken along lines 13—13 of FIG. 1 looking into the coin measuring area.

On the rear of the faceplate 17 is a flat sliding door 91, as shown in FIGS. 11 and 12, that includes a plurality of passageways 92 and is retained in position by a retainer plate 93 as shown in FIG. 8. In the coin receiving position of the slide assembly 28 as in FIG. 1, the passageways 92 in the door 91 are generally aligned with the passageways 45 in the faceplate 17 as in FIGS. 11 and 12 so that coins may pass through. As the coins 98 clear the passageway 92, however, the door 91 is moved transversely relative to the faceplate 17 by a cam surface 94 on the upper slide plate 31 engaging with a depending tab 95 on the sliding door 91 to effectively close the passageways 45 in the faceplate 17, thus preventing access to the coin measuring members during and after the measuring process. As the slide assembly 28 is returned to the coin receiving position, the sliding door 91 is returned by a cam 99 and depending tab 100 on the opposite side of the upper slide plate 31 and door 91 respectively to realign the passageways 45 and 92. The door passageways 92 are also formed with sharp edges to effect a cutting of tape or the like that may be attached to the coin 98 and thereby thwarting any attempt to obtain improper return of the coin 98 after effecting an actuation of the machine.

The slide assembly 28 is adapted to receive an actuator mounting bracket 96 secured by fasteners 90 as shown in FIGS. 1 and 2. Similarly, an actuator bracket 107, which is operable for actuating the timer 108 or other control device to initiate operation of the machine, is attached to the mounting bracket 96 by a pair of threaded members 106.

Figure 5:
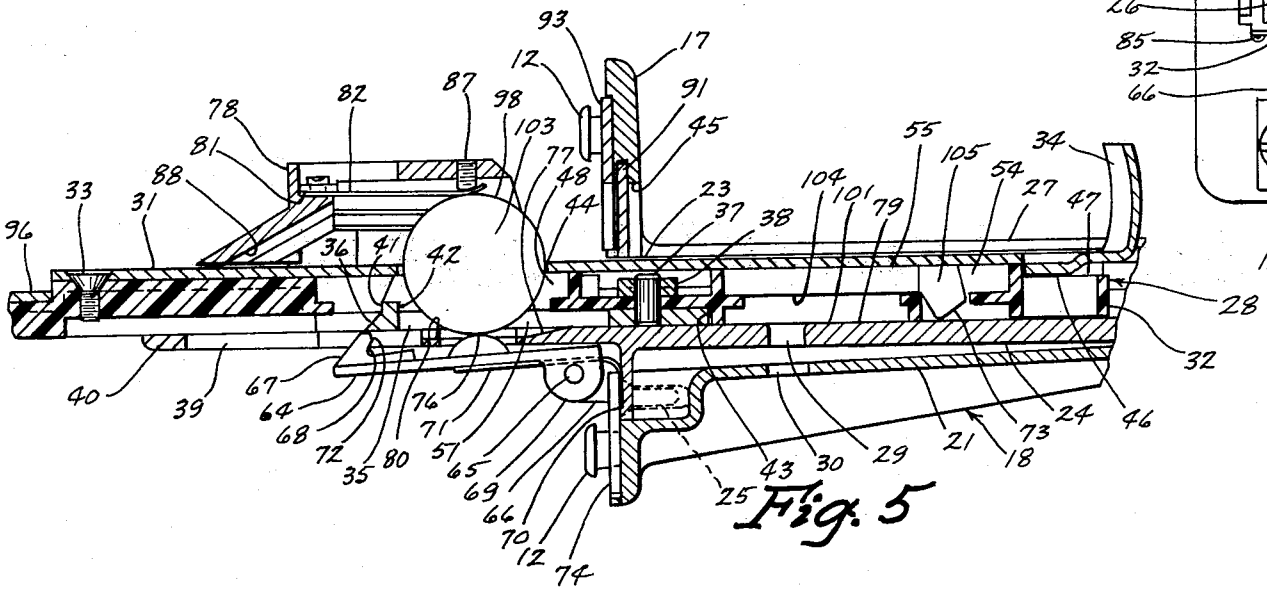
FIG. 5 is a view similar to FIG. 2 showing a proper coin advancing through the coin measuring area.
Figure 15:
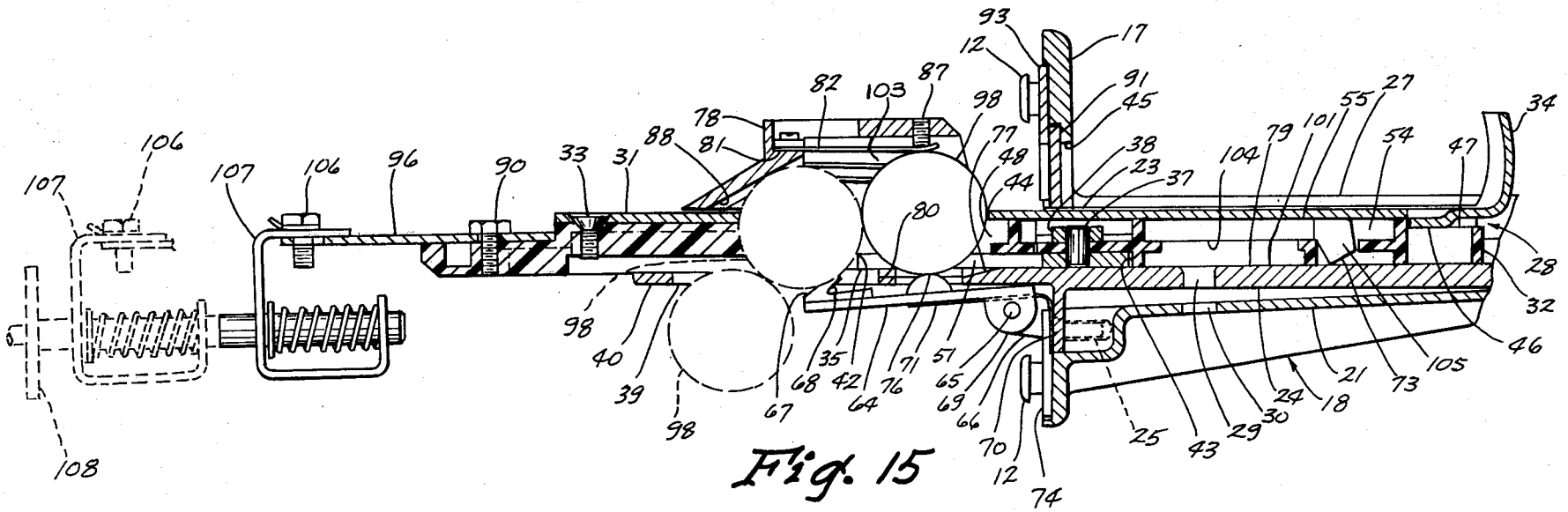
FIG. 15 is a view similar to FIG. 5 showing a proper coin advancing through the coin ejection position and dropping from the coin slide; also shown in dashed lines is the end of a fully extended coin slide in the operative position.

For purposes of discussing operation of the coin slide apparatus 10 with a proper coin 98, as in FIG. 5, it is assumed that a blanking member 55 has been operatively disposed in all of the coin slot 44 positions except one of the quarter slots through which the section of FIG. 5 is taken. After an authentic quarter is inserted in the appropriate slot 44, and enters the slot 44 with the lower edge resting on the surface of the guideway 101 of the slide housing 24 if the coin 98 is proper, the slide assembly 28 is advanced to carry the coin 98 toward the faceplate 17 and through the vertical passageway 45 therein. After the coin 98 passes the vertical passageway 45, the door 91 is cammed by the upper slide plate 31 transversely across the back of the faceplate 17, as in FIGS. 11 and 12, to block any further access to the coin 98. Continued advancement of the slide assembly 28 moves the coin 98 to the coin measuring area 103. During this advancement the coin 98 is moved down the ramp 77 formed in the slide housing 24 to the semicircular coin cam 76. With the bottom edge of the coin 98 engaging the coin cam 76 and the upper edge engaging the abutment 82, the latch arm 64 is pivoted downwardly by the advancing coin to position the latch pawl 67 below the plane of the latch plate 35. The slide assembly 28 is thus free to continue advancement through the coin ejection position, where the ramp portion 88 of the bridge 78 starts the coin 98 downward and rearward through a port 39 in the slide housing 24, as shown in FIG. 15, to the operative position. At the end of the actuation stroke of the slide assembly 28, the slide assembly 28 mounted actuator bracket 107 engages and effects operation of a timer 108 or the like. When the slide assembly 28 has reached this operative position it is prevented from further travel by the engagement of the stops 19 on the center body 32 with a mating forward land 49 on each upwardly extending wall 26 of the slide housing 24 as shown in FIG. 9. Upon completion of the inward actuation stroke of the slide assembly 28, the assembly 28 is returned to the coin receiving position by a return spring 97 that is mounted between the side of the actuator mounting bracket 96 and the retainer plate 93 as shown in FIG. 1. The return stroke is limited by the engagement of the actuated mounting bracket 96 with a rearward land 50 as shown in FIG. 9.

Figure 6:
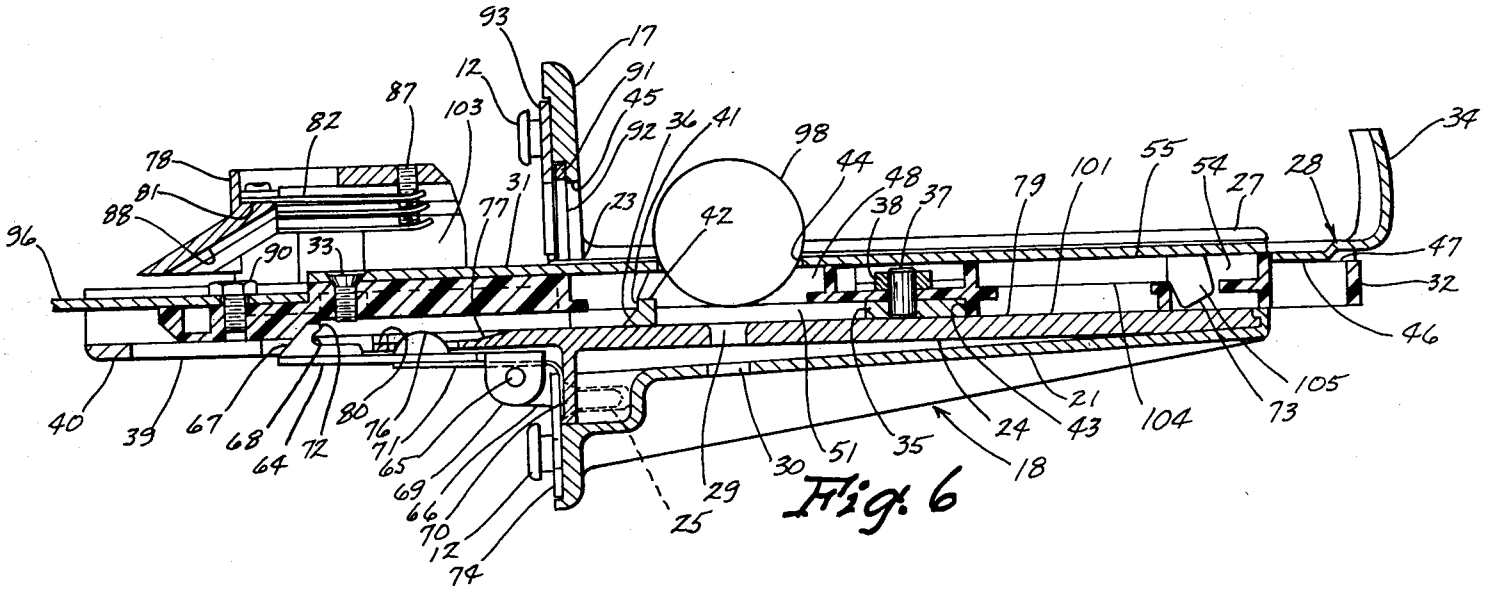
FIG. 6 is a view similar to FIG. 2 illustrating that a too large coin will not drop into the slot.

In the event that a coin 98 which is too large in diameter is used to attempt actuation of the machine, the coin will not seat properly in the coin slot 44 as shown in FIG. 6. With the too large coin 98 in this position, the slide assembly 28 will not be operable since the top of the coin 98 cannot clear the top edge of the vertical passageway 45 in the faceplate 17. In the event that a coin 98 is too thick, it will not pass the maximum thickness requirements of the coin slots 44 in the upper slide plate 31 and thus cannot be used.

Shown in FIG. 8 is the condition that occurs when a coin 98 of too small a diameter is used in an attempt to actuate the machine. The too small coin 98 will fit in the coin slot 44 and rest upon the slide housing 24. As the slide assembly 28 is advanced, the coin 98 will travel through the vertical passageway 45 in the faceplate 17, down the ramp 77 in the slide housing 28, and to the coin measuring area 103. At the coin measuring area 103, as shown in FIG. 8, the coin 98 is not large enough in diameter to span the distance between the coin cam 76 and the abutment 82, hence, the latch arm 64 is not cammed down and the latch plate 35 engages the pawl 67 of the latch arm 64, thus preventing any further advancement of the slide assembly 28.

Further, if actuation of the coin slide apparatus 10 is attempted without the presence of a coin 98 as shown in FIG. 4, the latch plate 35 will simply engage the pawl 67 of the latch arm 64 and prevent further advancement of the slide assembly 28.

FIGS. 16 through 24 show two alternative coin authenticating means that may optionally be used with this coin slide construction. These alternates are a washer reject means as shown in FIGS. 16 through 20 and a magnetic coin reject means as shown in FIGS. 21 through 24. These reject devices are both designed to mount in the same general area of the coin slide assembly so that if one is used the other cannot be. However, the slide assembly could be constructed so as to be converted from one device to another, depending on the needs of the customer, by exchanging the molded center body portion.

When it is desired to have a coin slide sensitive to washers or other coins with blank center portions 112 or to coins that are less than a predetermined thickness, the slide assembly may be altered by removing the center body portion 32 and replacing it with center body portion 110 which has provisions for mounting reject arms 120 and spring members 121.

The washer reject means as shown in FIGS. 16 through 20 consists of a plurality of washer reject arms 120 and sideways biasing spring members 121, one for each coin slot 44. The washer reject arms 120 are pivotally mounted in molded slots 122 in the center body 110 of the slide assembly 111 and have depending lugs 123, as in FIG. 16, which ride in tracks 124 in the guideway surface 101 of housing 24. At right angles to the body of the reject arm 120 is a finger 125 which extends into the pocket 48 and engages the coin 98 through biasing of the spring member 121. The spring member 121 is anchored in the center body portion 110 at one end with the other end of the spring 121 contacting the reject arm 120 and urging the arm 120 toward the coin 98.

The guideway surface 101 includes a track 124 for each of the pockets 48 with each track 124 having a transversely enlarged portion 126 and a shoulder 127 as shown in FIGS. 18, 19 and 20.

In operation, the depending lug portion 123 of the washer reject arm 120 rides in the track 124 as in FIG. 18. The reject arm 120 is urged toward the coin 98 by the spring member 121 and as the slide assembly 111 moves, if the coin 98 is less than a predetermined thickness or is a washer having a central opening 112, the finger portion 125 of the reject arm 120 will permit the reject arm 120 to shift toward the coin 98 and as the reject arm 120 moves along the transversely enlarged portion 126 and reaches the shoulder 127, as in FIG. 19, the reject arm 120 will engage the shoulder 127. If the coin 98 is proper, the reject arm 120 will remain along the upper portion 128 of the track 124 as in FIG. 20. A proper coin 98 will move through the coin measuring area 103 with the finger 125 of the washer reject arm 120 riding against the coin 98 as shown in FIG. 20.

To provide for a coin slide that will detect coins which have magnetic properties, the center body portion 32 is removed and replaced by center body portion 116 which is molded with appropriate grooves and slots for mounting a magnetic reject means.

The magnetic reject means as shown in FIGS. 21 through 24 includes a magnet mounting bracket 130 supported in grooved openings 131 in the center body portion 116 of the slide assembly 117 and transversely movable dependent on whether or not a magnetic coin 129 is encountered, a track 132 in the guideway surface 101 and a hairpin spring 133 on the outer wall 134 of the slide housing 24.

Figure 21:
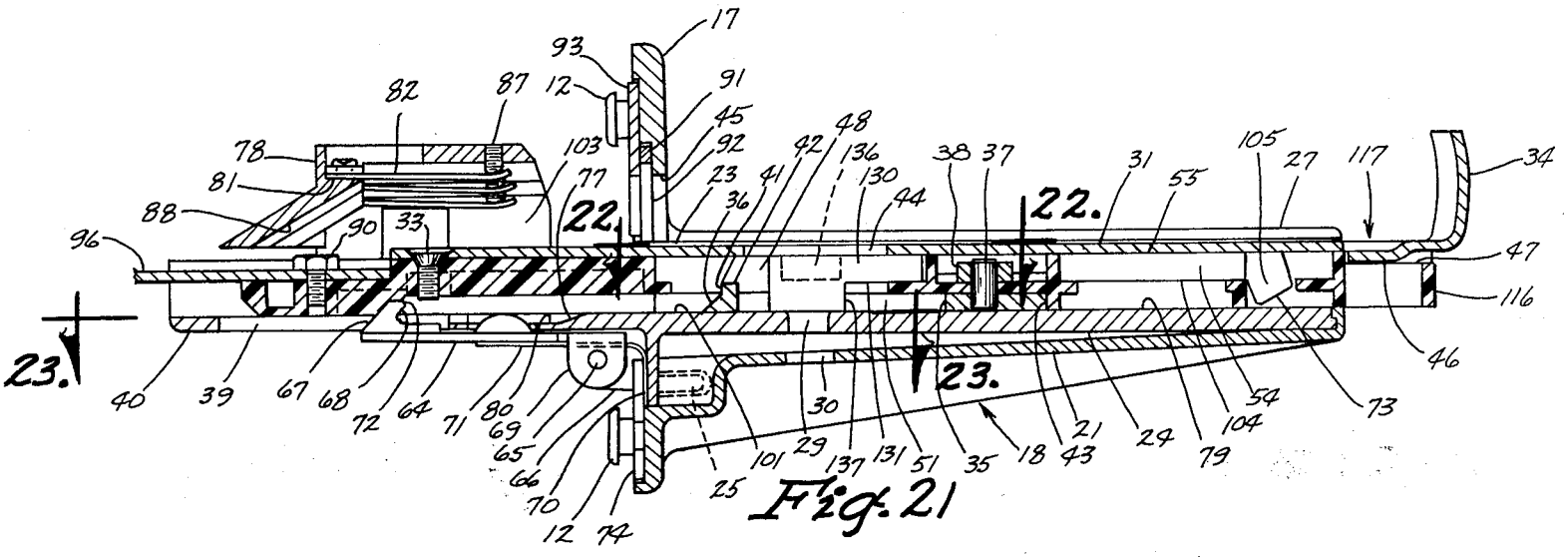
FIG. 21 is a view similar to FIG. 2 showing a magnetic reject means in relation to the coin slide and slide housing.
Figure 22:
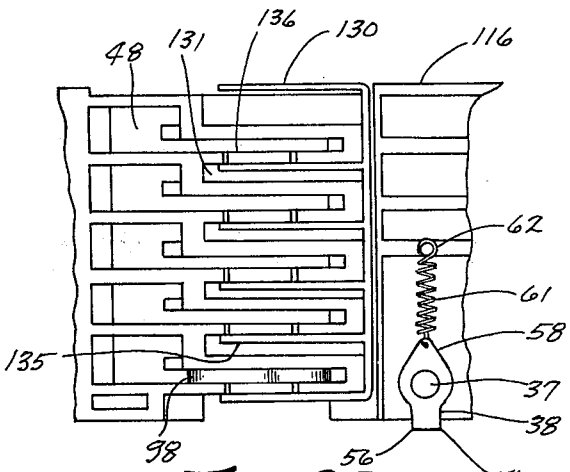
FIG. 22 is a fragmentary view taken generally along lines 22—22 of FIG. 21.
Figure 23:
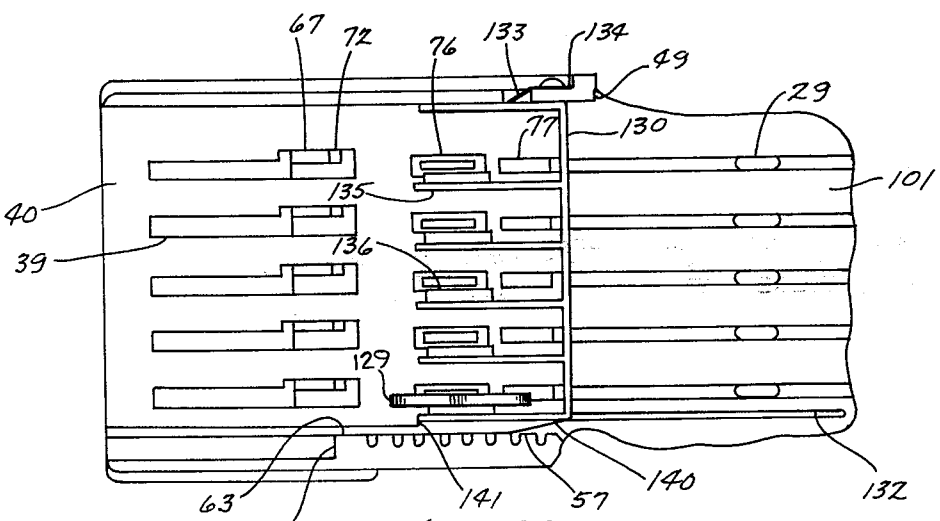
FIG. 23 is a fragmentary view taken generally along lines 23—23 of FIG. 21 with a coin slide assembly partially advanced and carrying a spurious magnetic coin.
Figure 24:
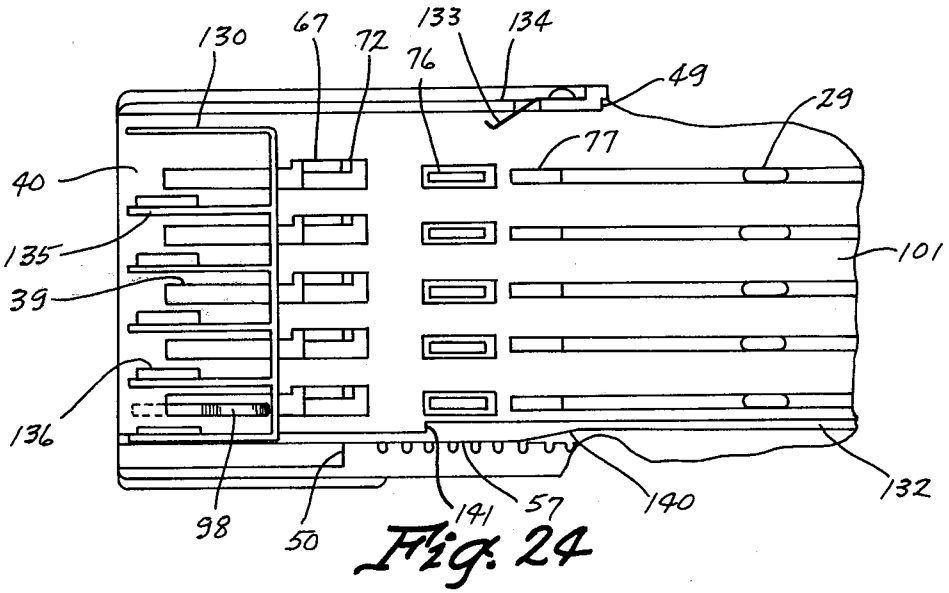
FIG. 24 is a view similar to FIG. 23 with the coin slide assembly carrying a proper non-magnetic coin and advanced beyond an intermediate stop position.

The bracket 130 has a plurality of members 135 for mounting small permanent magnets 136 to thus form magnetic members as shown in FIGS. 22, 23 and 24. The magnet mounting bracket 130 is located in the center body portion 116 of the slide assembly 117 so that a magnet 136 is adjacent each coin receiving pocket 48. As shown in FIG. 21 the bracket 130 also includes a downwardly projecting portion 137 which engages with and travels in the track 132 as the coin slide assembly is advanced and as shown in FIGS. 23 and 24.

Mounted on the outer wall 134 of the slide housing 24, FIGS. 23 and 24, is a hairpin spring 133. This spring 133 is strong enough to transversely bias the mounting bracket 130 toward the tapered wall portion 140 of the track 132 if there are no magnetic coins 129 present in the slide assembly 117. However, if there is a magnetic coin 129 in the slide assembly 117, the spring 133 will not have sufficient strength to move the mounting bracket 130 and the downwardly projecting portion 137 of the mounting bracket 130 will engage the bracket stop 141 to prevent further advancement of the coin slide assembly.

In review, the operation of the coin slide assembly 117 with the magnetic reject means is as follows. If a coin has magnetic properties the magnet 136 for the particular pocket 48 will attract it. As the slide assembly 117 is moved inward, the hairpin spring 133 does not have sufficient strength to overcome the magnetic attraction of the magnet 136 and the downwardly projecting portion 137 of the mounting bracket 130 will engage the bracket stop 141 as shown in FIG. 23. If the coins 98 are proper, the hairpin spring 133 will force the mounting bracket 130 transversely witin the center body 116 of the slide assembly 117 causing the downwardly projecting portion 137 of the bracket 130 to follow the tapered wall portion 140 of the track 132. The slide assembly 117 will then be free to travel toward the operative position as shown in FIG. 24.

The present construction thus provides an improved coin slide apparatus offering fast, convenient conversion from one combination of coins to another. The construction offers a unique slide assembly having improved operational characteristics and providing for storage of conversion pieces. The present slide assembly is also functional as a structural support for a ratchet mechanism and as a load bearing member capable of absorbing shock impacts as well as performing the usual authenticating and actuation functions of a prior art slide assembly. The construction also features either a washer reject or a magnetic coin reject option.

In the drawings and specification, there has been set forth a preferred embodiment of the invention and although specific terms are employed these are used in a generic and descriptive sense only and not for purposes of limitation. Changes in form and the proportion of parts as well as the substitution of equivalents are contemplated as circumstances may suggest or render expedient without departing from the spirit or scope of the invention as further defined in the following claims.

We claim:

1. A coin slide apparatus for initating the operation of a machine with a predetermined combination of coins supported substantially vertically on edge, comprising: slide support means for mounting said coin slide apparatus to said machine and including a generally vertical faceplate having at least one vertical passageway for passing coins on edge and further including a forwardly and rearwardly extending slide housing defining a coin slide guideway; a coin slide assembly supported on said slide housing and reciprocally movable in said guideway from a coin receiving position and through intermediate coin measuring and coin ejecting positions to an operative position for activating said machine, said slide assembly including a plurality of slots of predetermined size for receiving and supporting said coins for movement with said slide assembly, said slide housing including a guideway surface for supporting said coins in said slots at a first elevation relative to said coin slide assembly in said coin receiving position and further including a downwardly sloping ramp in said guideway surface permitting said coins to drop from said first elevation to a lower second elevation as said slide assembly is moved from said coin receiving position to said coin measuring position; stop means for preventing movement of said slide assembly to said operative position in the absence of said predetermined combination of coins and including a plurality of latch arms pivotally mounted on said slide housing, each of said arms having a pawl engageable with said slide assembly in a first posture of said arms to prevent movement of said slide assembly beyond said coin measuring position; coin authenticating means comprising a cam on each of said latch arms and an abutment on said slide housing spaced above the cam of each latch arm and cooperable with said cam for engaging with opposite edges of said coins, each of said latch arm being responsive to a coin of a predetermined diameter operating on said cam at said lower elevation for pivoting to a second posture for nonengagement with said slide assembly, said slide assembly being movable beyond said coin measuring position toward said operating position only when all of said plurality of latch arms are pivoted to said second postures; and coin ejection means including at least one open port in said slide housing through which coins are ejected.

2. A coin slide apparatus as defined in claim 1 where each abutment is individually adjustable to a predetermined coin diameter.

3. A coin slide apparatus as defined in claim 1 wherein said plurality of slots are shaped with a length approximately a predetermined coin's diameter and a width at the ends of the slots approximating a predetermined coin's thickness with a center portion of said slots being substantially wider than the thickness of said coins for receiving coins which may be slightly deformed in the center portion.

4. A coin slide apparatus as defined in claim 1 wherein said coin authenticating means further includes a washer reject means responsive to a coin of less than a predetermined thickness or to a washer for jamming said coin slide apparatus thus preventing movement of said slide assembly to said operative position.

5. A coin slide apparatus as defined in claim 1 wherein said coin authenticating means includes a magnetic reject means operable for detecting coins having magnetic properties and upon said detection preventing further advancement of said coin slide.

6. A coin slide apparatus as defined in claim 1 wherein said support means further includes a forwardly extending housing support integral with said faceplate and cooperable with said forwardly and rearwardly extending slide housing to define a guideway for supporting and guiding said coin slide assembly.

7. A coin slide apparatus for initiating the operation of a machine with a predetermined combination of coins supported substantially vertically on edge, comprising: slide support means for mounting said coin slide apparatus to said machine including a generally vertical faceplate having a plurality of vertical passageways for passing coins on edge and further including a forwardly and rearwardly extending slide housing defining a coin slide guideway; a coin slide assembly supported on said housing and reciprocally movable in said guideway from a coin receiving position and through intermediate coin measuring and coin ejecting to an operative position for activating said machine, said slide assembly including a plurality of slots of predetermined size for receiving and supporting said coins for movement with said slide assembly, said slide housing including a guideway surface for supporting said coins in said slots at a first elevation relative to said coin slide assembly in said coin receiving position and further including a downwardly sloping ramp in said guideway surface permitting said coins to drop from said first elevation to a lower second elevation as said slide assembly is moved from said coin receiving position to said coin measuring position; stop means for preventing movement of said slide assembly to said operative position in the absence of said predetermined combination of coins and including a plurality of latch arms pivotally mounted on said slide housing, each of said arms having a pawl engagement in a first position with said slide assembly in a first posture of said arms to prevent movement of said slide assembly beyond said coin measuring position; coin authenticating means comprising a cam on each of said latch arms and an abutment spaced above the cam of each latch arm and cooperable with said cam for engaging with opposite edges of said coins, said abutments supported by a bridge structure mounted on said slide housing, said arm being responsive to coins of a predetermined diameter operating on said cam at said lower elevation for pivoting to a second posture for nonengagement with said slide assembly, said slide assembly being movable beyond said coin measuring position toward said operating position only when all of said plurality of latch arms are pivoted to said second postures; and coin ejection means including at least one open port in said slide housing through which coins are ejected.

8. A coin slide apparatus as defined in claim 7 wherein said abutments are adjustable in a vertical plane for maintaining a predetermined distance between said abutment and said cam.

9. A coin slide apparatus as defined in claim 7 wherein said bridge further includes downwardly and rearwardly sloping surfaces substantially in line with each coin path for deflecting said coins in a downward and rearward direction when said coin has passed through said coin measuring position toward said coin ejection position to insure that said coins are ejected from said coin slide assembly.

10. A coin slide apparatus for initiating the operation of a machine with a predetermined combination of coins supported substantially vertically on edge, comprising: support means for mounting said coin slide apparatus to said machine and including a generally vertical faceplate having a plurality of vertical passageways for passing coins on edge and further including a forwardly and rearwardly extending slide housing defining a coin slide guideway; a coin slide assembly supported on said housing and reciprocally movably in said guideway from a coin receiving position and through intermediate coin measuring and coin ejecting positions to an operative position for activating said machine, said slide assembly including a plurality of slots of predetermined size for receiving and supporting said coins for movement with said slide assembly, said slide housing including a guideway surface for supporting said coins in said slots at a first elevation relative to said coin receiving position and further including a downwardly sloping ramp in said guideway surface permitting said coins to drop from said first elevation to a lower second elevation as said slide assembly is moved from said coin receiving position to said coin measuring position; stop means for preventing movement of said slide assembly to said operative position in the absence of said predetermined combination of coins and including a plurality of latch arms pivotally mounted on said slide housing, each of said arms having a pawl engageable in a first position with said slide assembly in a first posture of said arms to prevent movement of said slide assembly beyond said coin measuring position; coin authenticating means including the plurality of slots in the upper slide plate of said slide assembly for effecting preliminary measuring of each of said coins with said slots being of a length approximating a predetermined coin's diameter and a width at the ends of the slots approximating a predetermined coin's thickness with a center portion of said slots being substantially wider than the thickness of said coins for receiving coins which may be slightly deformed in the center, said coin authenticating means further including a cam on each of said latch arms and an abutment spaced above the cam of each latch arm and cooperable with said cam for engaging with opposite edges of said coins, said abutments being supported by a bridge structure mounted on said slide housing, said arm being responsive to coins of a predetermined diameter operating on said cam at said lower elevation for pivoting to a second posture for nonengagement with said slide assembly, said slide assembly being movable beyond said coin measuring position toward said operating position only when all of said plurality of latch arms are pivoted to said second postures; and coin ejection means including at least one open port in said slide housing through which coins are ejected.

11. A coin slide apparatus for initating the operation of a machine with a predetermined combination of coins supported substantially vertically on edge, comprising: slide support means for mounting said coin slide apparatus to said machine including a generally vertical faceplate having at least one opening for passing coins on edge and further including a forwardly and rearwardly extending slide housing defining a coin slide guideway; a coin slide assembly supported on said slide housing and reciprocally movable in said guideway from a coin receiving position through intermediate coin measuring and coin ejecting positions to an operative position for activating said machine, said slide assembly including a plurality of slots of predetermined size for receiving and supporting said coins for movement with said slide assembly; slide movement control means for preventing movement of said slide assembly to said operative position in the absence of said predetermined combination of authentic coins each having a predetermined diameter; coin authenticating means including means for checking the diameter of each of said coins and further including a washer reject arm adjacent each of said plurality of slots for detecting coins of less than a predetermined thickness and washers having a generally central opening and upon said detection said reject arm being engageable with said coin slide guideway for preventing further advancement of said slide assembly, said slide assembly being movable beyond said coin measuring position toward said operating position only when all of said coins have said predetermined diameter and thickness and are free of central openings; and coin ejection means including at least one open port in said slide housing through which coins are ejected.

12. A coin slide apparatus as defined in claim 11 wherein said washer reject arm includes a transversely extending finger portion biased toward the coins in said slot for achieving said detection of said coins of less than a predetermined thickness or washers having a generally central opening.

13. A coin slide apparatus as defined in claim 12 wherein said washer reject arm includes a depending lug portion longitudinally movable in a track in said guideway, said depending lug portion being engagable with a shoulder in said track upon said detection of said coins of less than a predetermined thickness or washers having a generally central opening.

14. A coin slide apparatus for initiating the operation of a machine with a predetermined combination of coins supported substantially vertically on edge, comprising: slide support means for mounting said coin slide apparatus to said machine including a generally vertical faceplate having at least one opening for passing coins on edge and further including a forwardly and rearwardly extending slide housing defining a coin slide guideway; a coin slide assembly supported on said slide housing and reciprocally movable in said guideway from a coin receiving position through intermediate coin measuring and coin ejecting positions to an operative position for activating said machine, said slide assembly including a plurality of slots of predetermined size for receiving and supporting said coins for movement with said slide assembly; slide movement control means for preventing movement of said slide assembly to said operative position in the absence of said predetermined combination of authentic coins and including a plurality of latch arms engageable with said slide assembly in the absence of coins of a predetermined diameter; coin authenticating means including the plurality of slots in said slide assembly for effecting preliminary measuring of each of said coins, said coins authenicating means further includes a washer reject arm for each of said plurality of slots with said reject arm being retained generally within said slide assembly alongside said slot and responsive to advancement of said slide assembly for detecting coins of less than a predetermined thickness and washers having a generally central opening and upon said detection said reject arm being engageable with said coin slide guideway for preventing further advancement of said slide assembly, said coin authenticating means still further includes a cam on each of said latch arms and an abutment on said housing spaced above the cam of each latch arm and cooperable with said cam for engaging with opposite edges of said coins, each of said latch arms being responsive to a coin of a predetermined diameter operating on said cam for pivoting said latch arm to a posture for nonengagement with said slide assembly, said slide assembly being movable beyond said coin measuring position toward said operating position only when all of said plurality of latch arms are pivoted and when said reject arms are disengaged from said coin slide guideway; and coin ejection means including at least one open port in said slide housing through which coins are ejected.

15. A coin slide apparatus a defined in claim 14 wherein said washer reject arms include a depending lug portion longitudinally movable in tracks in said guideway, said tracks further including a transversely enlarged portion for accommodating lateral movement of said reject arms and a shoulder engageable by said reject arms in the presence of the said coins of less than a predetermined thickness and said washers having a generally central opening.

16. A coin slide apparatus as defined in claim 15 wherein each of said washer reject arms further includes a transversely extending finger portion biased toward said coins for detecting said coins of less than predetermined thickness and said washers having a generally central opening and upon said detection effecting engagement of said depending lug with said shoulder to prevent further advancement of said slide assembly.

17. A coin slide apparatus for initiating the operation of a machine with a predetermined combination of coins supported substantially vertically on edge, comprising: slide support means for mounting said coin slide apparatus to said machine including a generally vertical faceplate having at least one opening for passing coins on edge and further including a forwardly and rearwardly extending slide housing defining a coin slide guideway; a coin slide assembly supported on said housing and reciprocally movable in said guideway from a coin receiving position through intermediate coin measuring and coin ejecting positions to an operative position for activating said machine, said slide assembly including a plurality of slots of predetermined size for receiving and supporting said coins for movement with said slide assembly; slide movement control means for preventing movement of said slide assembly to said operative position in the absence of said predetermined combination of authentic coins each having a predetermined diameter; coin authenticating means including means for checking the diameter of each of said coins and further including a magnetic reject means including a magnetic member adjacent each of said slots for detecting coins with magnetic properties and upon said detection said magnetic means being movable into engagement with a portion of said coin slide guideway to prevent further advancement of said slide assembly, said slide assembly being movable beyond said coin measuring position toward said operating position only when all of said coins have said predetermined diameter and are nonmagnetic; and coin ejection means including at least one open port in said slide housing through which coins are ejected.

18. A coin slide apparatus as defined in claim 17 wherein said magnetic members are supported on a unitary bracket supported generally within said inside assembly for lateral movement relative thereto.

19. A coin slide apparatus as defined in claim 17 wherein said magnetic reject means includes a spring means on said slide housing for biasing said magnetic reject means away from engagement with said portion of said coin slide guideway if said coins are nonmagnetic.

20. A coin slide apparatus for initiating the operation of a machine with a predetermined combination of coins supported substantially vertically on edge, comprising: slide support means for mounting said coin slide apparatus to said machine; including a generally vertical faceplate having at least one opening for passing coins on edge and further including a forwardly and rearwardly extending slide housing defining a coin slide guideway; a coin slide assembly supported on said slide housing and reciprocally movable in said guideway from a coin receiving position through intermediate coin measuring and coin ejecting positions to an operative position for activating said machine, said slide assembly including a plurality of slots of predetermined size for receiving and supporting said coins for movement with said slide assembly; slide movement control means for preventing movement of said slide assembly to said operative position in the absence of said predetermined combination of authentic coins and including a plurality of latch arms engageable with said slide assembly in the absence of coins of a predetermined diameter; coin authenticating means including the plurality of slots in said slide assembly for effecting preliminary measuring of each of said coins, said coin authenticating means further includes a mangetic reject means comprising a magnetic member adjacent each of said slots and being responsive to a magnetic coin for movement into engagement with a portion of said coin slide guideway to prevent advancement of said slide assembly, said coin authenticating means still further including a cam on each of said latch arms and an abutment on said slide housing spaced above the cam of each latch arm and cooperable with said cam for engaging with opposite edges of said coins, each of said latch arms being responsive to a coin of a predetermined diameter operating on said cam for pivoting said latch arm to a posture for nonengagement with said slide assembly, said slide assembly being movable beyond said coin measuring position toward said operating position only when all of said plurality of latch arms are pivoted and said magnetic reject means is disengaged from said coin slide guideway; and coin ejection means including at least one open port in said slide housing through which coins are ejected.

21. A coin slide apparatus as defined in claim 20 wherein said magnetic reject means further includes a mounting bracket retained generally witin said slide assembly for mounting said magnetic members with said bracket being transversely movable relative to said slide assembly for engagement with said guideway in response to said magnetic coin.

22. A coin slide apparatus as defined in claim 21 wherein said magnet mounting bracket includes a downwardly projecting portion longitudinally movable in a track in said guideway surface, said track including a stop for engaging said downwardly projecting portion of said magnetic reject means responsive to a magnetic coin to prevent advancement of said coin slide assembly.

23. A coin slide apparatus as defined in claim 21 wherein said magnetic reject means is supported generally within said slide assembly with said magnetic fingers being juxtaposed to said coins for effecting lateral movement of said mounting bracket if said coins are magnetic.

* * * * *

UNITED STATES PATENT AND TRADEMARK OFFICE

CERTIFICATE OF CORRECTION

PATENT NO. : 3,978,960

DATED : September 7, 1976

INVENTOR(S) : John C. Mellinger
William J. McNally

It is certified that error appears in the above-identified patent and that said Letters Patent are hereby corrected as shown below:

| | |
|---|---|
| Abstract, line 8 | "side" should be -- slide -- |
| Col. 10, line 6 | "witin" should be -- within -- |
| Claim 1, line 34 | "initating" should be -- initiating -- |
| Claim 3, line 16 | "approximately" should be -- approximating -- |
| Claim 7, line 51 | after "ejecting" insert -- positions -- |
| Claim 7, line 68 | "engagement" should be -- engageable -- |
| Claim 14, line 30 | after "said" (second occurrence) insert -- slide -- |
| Claim 15, line 44 | "a" should be -- as -- |
| Claim 18, line 29 | "inside" should be -- slide -- |
| Claim 20, line 41 | delete ";" |
| Claim 20, line 10 | "mangetic" should be -- magnetic -- |

Signed and Sealed this

Sixteenth Day of November 1976

[SEAL]

*Attest:*

RUTH C. MASON
*Attesting Officer*

C. MARSHALL DANN
*Commissioner of Patents and Trademarks*